United States Patent [19]

Kamai

[11] Patent Number: 4,640,253

[45] Date of Patent: Feb. 3, 1987

[54] ELECTRONIC FUEL INJECTION CONTROL WITH VARIABLE INJECTION TIMING

[75] Inventor: Kenichiro Kamai, Toyoake, Japan

[73] Assignee: Nippondenso Co., Ltd., Kariya, Japan

[21] Appl. No.: 749,090

[22] Filed: Jun. 26, 1985

[30] Foreign Application Priority Data

Jun. 26, 1984 [JP] Japan ..... 59-131274

[51] Int. Cl.[4] ..... F02M 51/00

[52] U.S. Cl. ..... 123/475; 123/478

[58] Field of Search ..... 123/414, 475, 478, 480

[56] References Cited

U.S. PATENT DOCUMENTS

| | | | |
|---|---|---|---|
| 3,855,973 | 12/1974 | Scofield | 123/475 X |
| 4,058,709 | 11/1977 | Long | 123/475 X |
| 4,180,023 | 12/1979 | Kobayashi et al. | 123/475 |
| 4,226,215 | 10/1980 | Kobayashi et al. | 123/487 |
| 4,407,258 | 10/1983 | Ruf | 123/414 X |
| 4,543,936 | 10/1985 | Gardner | 123/478 X |

FOREIGN PATENT DOCUMENTS 0027626 3/1979 Japan .

*Primary Examiner*—Willis R. Wolfe, Jr.

*Attorney, Agent, or Firm*—Cushman, Darby & Cushman

[57] ABSTRACT

In an electronic fuel injection control system for an internal combustion engine having an odd number of cylinders wherein the fuel injection is performed by supplying fuel injection valves with a fuel injection pulse signal having a duration indicative of the quantity of fuel to be injected into the engine and two injection pulse signals are generated in each engine cycle on the basis of ignition signals, the first injection pulse signal is generated in response to the first ignition signal in each engine cycle and the second injection pulse signal is generated after the elapse of an additional period of time from the generation of $(m+1)/2^{th}$ ignition signal where m represents the number of cylinders. The additional period of time is basically established to the half of an ignition interval and is trimmed in accordance with the variation of engine speed.

10 Claims, 8 Drawing Figures

ELECTRONIC FUEL INJECTION CONTROL WITH VARIABLE INJECTION TIMING

BACKGROUND OF THE INVENTION

The present invention relates to fuel injection control system and method for an internal combustion engine having an odd number of cylinders, and more particularly to such control system and method wherein fuel injection is effected twice in each engine cycle on the basis of ignition signals.

A system for controlling fuel injection into an internal combustion engine is well known in which an electronically-controlled fuel injection system wherein the fuel injection quantity to be supplied to the engine is controlled by the pulse duration of a fuel injection control pulse signal applied to solenoid-operated injection valves to meet power demands under varying engine operating conditions and fuel injection is effected twice at intervals of two revolutions of the engine crankshaft or each engine cycle in synchronism with an ignition signal generated by an ignition system of the engine.

Such a system is being used successfully for internal combustion engines having an even number of cylinders, such as four cylinders. However, it is not compatible with internal combustion engines having an odd number of cylinders because it is impossible to obtain equally spaced fuel injection timings when it is intended to perform fuel injection in twice in each engine cycle on the basis of the ignition signal. More specifically, if the ignition signal is used as it is for causing fuel injection, fuel injection occurs in a period of time between two successive ignitions.

One possible solution is to provide a sensor for sensing the angular position of the engine at intervals of 180°. However, this results in a complex structure and an increase in cost. U.S. Pat. No. 4,180,023 issued Dec. 25, 1979 to the same asignee as the present invention discloses an electronically-controlled fuel injection system for internal combustion engines having an odd number of cylinders for eliminating the above-mentioned problems. This involves a technique wherein the fuel injection is effected after a elapse of time from an ignition timing by the half of the time interval between successive two ignition timings.

According to this prior art system, however, the fuel injection timing suffers from an undesirable delay when the engine speed increases and also suffers from an undesirable advance when the same decreases. That is, this system makes it difficult to stabilize fuel injection timing under varying engine operating conditions, resulting in the deterioration of exhaust emission and the occurrence of shock within a vehicle.

SUMMARY OF THE INVENTION

It is accordingly an object of the present invention to provide a new and improved electronic fuel injection control system which overcomes the above-described disadvantages inherent in the prior art control system.

With this and other objects which will be become apparent as the description proceeds, an electronic fuel injection control system for an internal combustion engine having an odd number of cylinders according to the present invention comprises a control unit for measuring the variation of engine speed in accordance with the ignition signal from the ignition system, supplying the solenoid-operated valves with the first fuel injection signal in response to the first ignition signal in each engine cycle, supplying the same with the second fuel injection signal after the elapse of an additional period of time from the time of the output of the $(m+1)/2$th ignition signal where m represents the number of cylinders that is equal to or greater than 3, and controlling the additional period of time according to a signal indicative of the variation of engine speed. In the system, two injection pulses are generated in succession during each engine cycle and the quantity of fuel to be injected into the engine is expressed by the duration of the injection pulse which is derived from engine operating conditions.

According to a feature of the present invention, the additional period of time is basically established to the half of an ignition pulse interval and the basic additional period of time is lengthened when engine speed decreases and is contrariwise shortened when the same increases.

Thus, the present invention not only makes possible equal-time-interval fuel injections for internal combustion engines having an odd number of cylinders, but also offers a further feature of making it possible to stabilize fuel injection timings irrespective of the variation of engine operating conditions.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
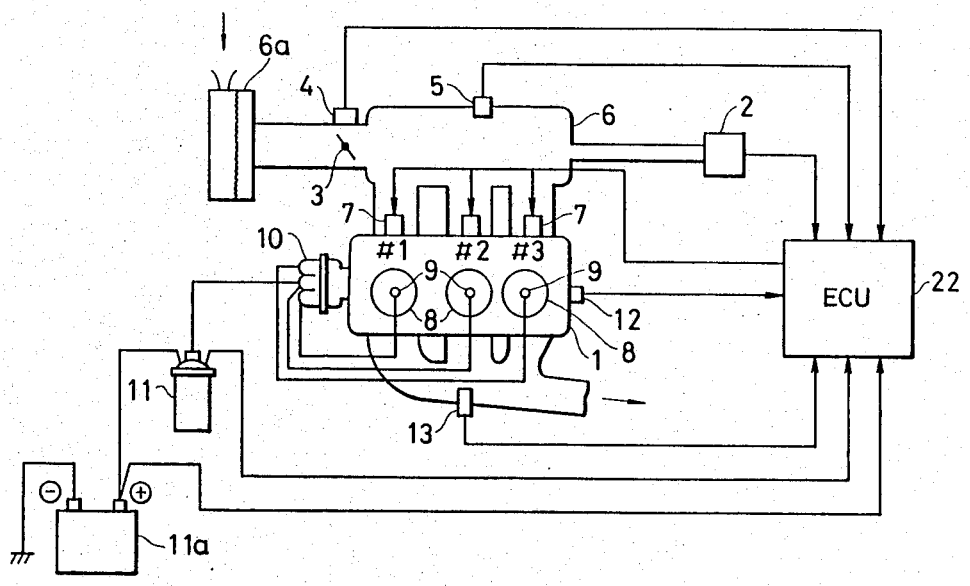
FIG. 1 is a schematic block diagram showing an electronic fuel injection control system according to the present invention incorporated with a three-cylinder internal combustion engine.

Referring now to FIG. 1, there is illustrated an electronic fuel injection control system according to the present invention incorporated with a three-cylinder internal combustion engine 1, which is provided with an intake system including an intake pressure sensor 2 for detecting an intake pressure of an intake manifold 6 having an air cleaner 6*a*, a throttle valve 3 which is operatively coupled to an accelerating pedal (not shown), a throttle sensor 4 for detecting an angular position of the throttle valve 3 and a temperature sensor 5 for detecting an intake air temperature. Air sucked in the intake manifold 6 through the throttle valve 3 is mixed with fuel to be injected into cylinders 8 by means of solenoid-operated fuel injection valves 7 and the mixture is ignited by spark plugs 9 built in the cylinders 8. An ignition distributor 10 supplies each of the spark plugs 9 with high voltage generated by an ignition coil 11 coupled to a battery 11*a* in synchronism with the rotation of the engine 1. The engine 1 is further provided with various sensors for detecting engine operating conditions, such as an engine coolant temperature sensor 12 and an oxygen sensor 13.

A fuel injection control unit 22 is powered by the battery 11*a* and coupled to the above-described sensors to derive optimum fuel injection quantity from output signals thereof. The quantity is expressed by the duration of an injection pulse to be applied to the solenoid-operated fuel injection valves 7. The fuel injection control unit 22 is further coupled to the ignition coil 11 so that fuel injection timings are controlled on the basis of ignition signals supplied therefrom.

Figure 2:
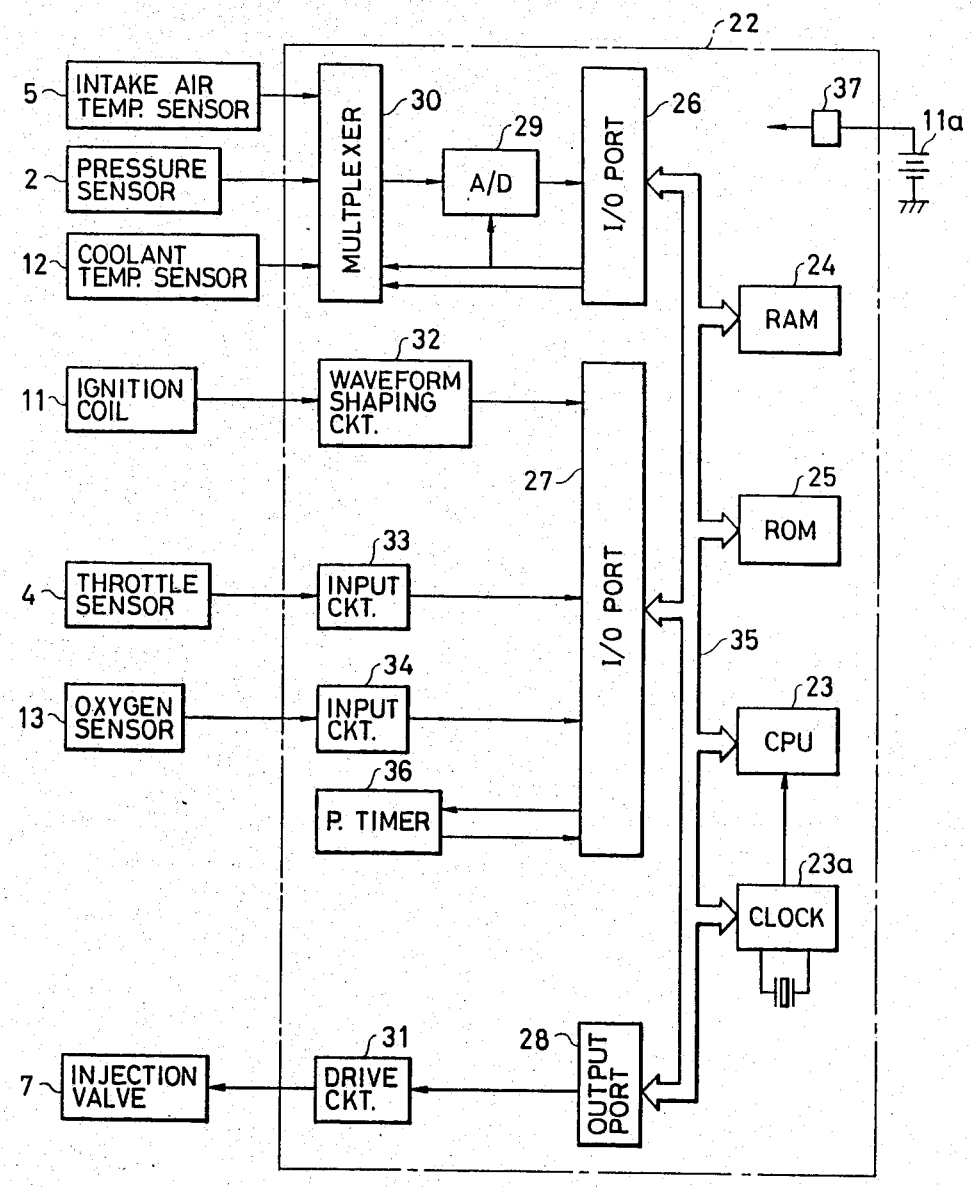
FIG. 2 is a schematic block diagram showing the fuel injection control unit of an electronic fuel injection control system according to the present invention.

FIG. 2 is a schematic block diagram showing the fuel injection control unit 22 of an electronically-controlled fuel injection system according to the present invention.

The fuel injection control unit 22 includes a central processing unit (CPU) 23 which performs the fuel injection control in accordance with programed instructions. The CPU 23 is coupled through a common bus 35 to its associated units including a read-only memory (ROM) 25, random access memory (RAM) 24, input/output ports 26 and 27, output port 28, and clock pulse generator 23*a*. The output signals of the intake pressure sensor 2, intake air temperature sensor 5 and engine coolant temperature sensor 12 are coupled through a multiplexer 30 and A/D converter 29 to the input/output port 26. Signals appearing at the primary winding of ignition coil 11 are supplied through a waveform shaping circuit 32 to the input/output port 27 and the output signals of the throttle angular position sensor 4 and oxygen sensor 13 are also supplied thereto through respective input circuits 33 and 34. In the CPU 23, signals supplied from the various sensors are processed in accordance with the programmed instructions stored in the ROM 25 to control its associated units. The RAM 24 temporarily stores input data and various data necessary for the operation. Also coupled through the input/output port 27 to the CPU 23 is a programmable timer 36 which enables programming an additional period of time Ta in accordance with instructions from the CPU. To be more precise, the timer 36 starts counting in response to an instruction from the CPU 23 and generates a fuel injection pulse signal after the elapse of a programmed additional period of time Ta. The solenoid-operated fuel injection valves 7 are controlled in accordance with a fuel injection pulse signal supplied thereto through the output port 28 and a drive circuit 31. Power is supplied from the battery 11*a* through a power circuit 37 to the fuel injection control unit 22.

Figure 3:
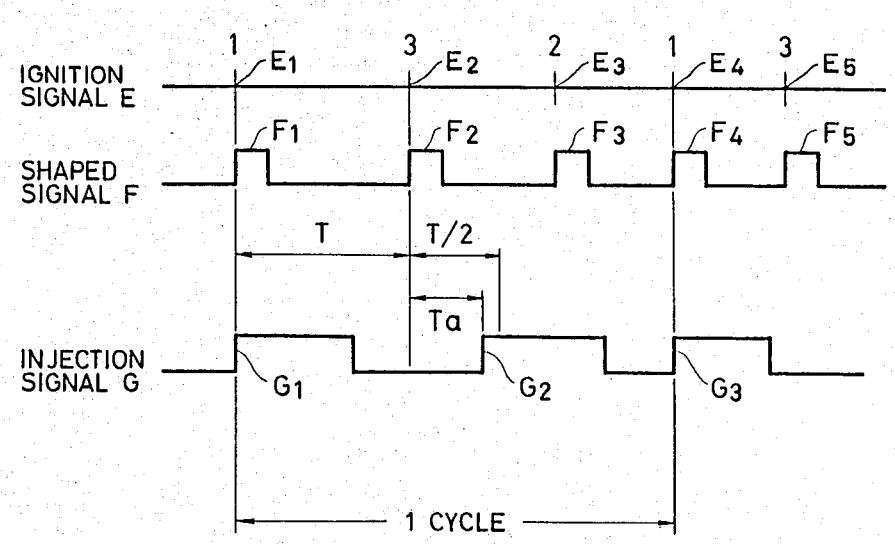
FIG. 3 is a time chart useful for understanding the operation of the fuel injection control unit.

FIG. 3 is a time chart useful for understanding the operation of the fuel injection control unit 22 in the case that the present invention is employed for a three-cylinder internal combustion engine.

In three-cylinder internal combustion engines, ignition signals are generated in the order of first cylinder, third cylinder and second cylinder which are represented at numerals 1, 3 and 2 in the chart. Designated at the references E1 to E5 are ignition signals supplied from the ignition coil 11 to waveform shaping circuit 32. The waveform shaping circuit 32 supplies the input/output port 27 with pulse signals designated at the references F1 to F5 and fuel injection pulse signals applied from the drive circuit 31 to the solenoid-operated fuel injection valves 7 are represented at the references G1 to G3. In each engine cycle, the first fuel injection pulse signal G1 is first applied to the solenoid-operated fuel injection valves 7 in synchronism with the ignition signal E1 for the first cylinder. The second fuel injection pulse signal G2 is applied thereto after the elapse of an additional period of time Ta from the time of the generation of the ignition signal E2 for the third cylinder.

This additional period of time Ta is basically set to half of an interval between successive ignition signals E1 and E2, and trimmed in accordance with engine operating conditions. That is, the basic additional period of time is trimmed in a decreasing direction when the engine speed increases and it is trimmed in an increasing direction when the same decreases. The engine speed is derived from ignition pulses.

The additional period of time Ta is given, for example, by the following equation:

$$Ta=(T/2)\times FNEDEL$$

where T is the interval between two consecutive ignition signals E1 and E2 and T/2 is a basic additional period of time which is estimated as the half period of an interval between the ignition signals E2 and E3, and FNEDEL represents a trimming coefficient.

Figure 4:
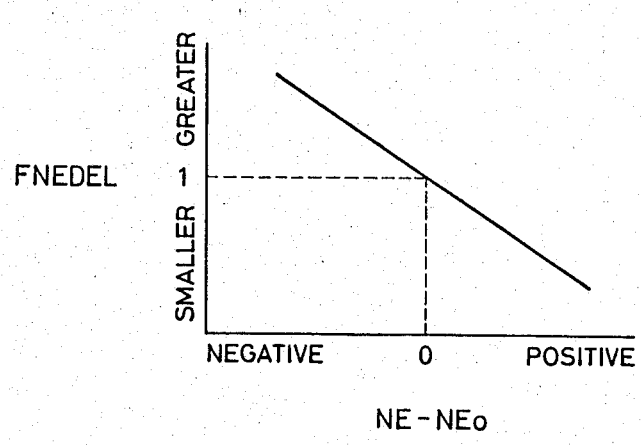
FIG. 4,is a graph showing a variable named FNEDEL with respect to the difference between the present engine speed NE and the last engine speed NEo.

FNEDEL is derived from the difference between engine speed NE obtained in synchronism with the ignition signal E2 and engine speed NEo obtained in synchronism with the ignition signal E1 as illustrated in FIG. 4 which is a graph showing FNEDEL with respect to the difference between NE and NEo. According to FIG. 4, when $NE-NEo>0$, that is, the engine speed is increasing, the additional period of time Ta is set to a value less than the basic additional period of time T/2, and when $NE-NEo<0$, that is, the engine speed is decreasing, Ta is set to a value greater than T/2.

Figure 5:
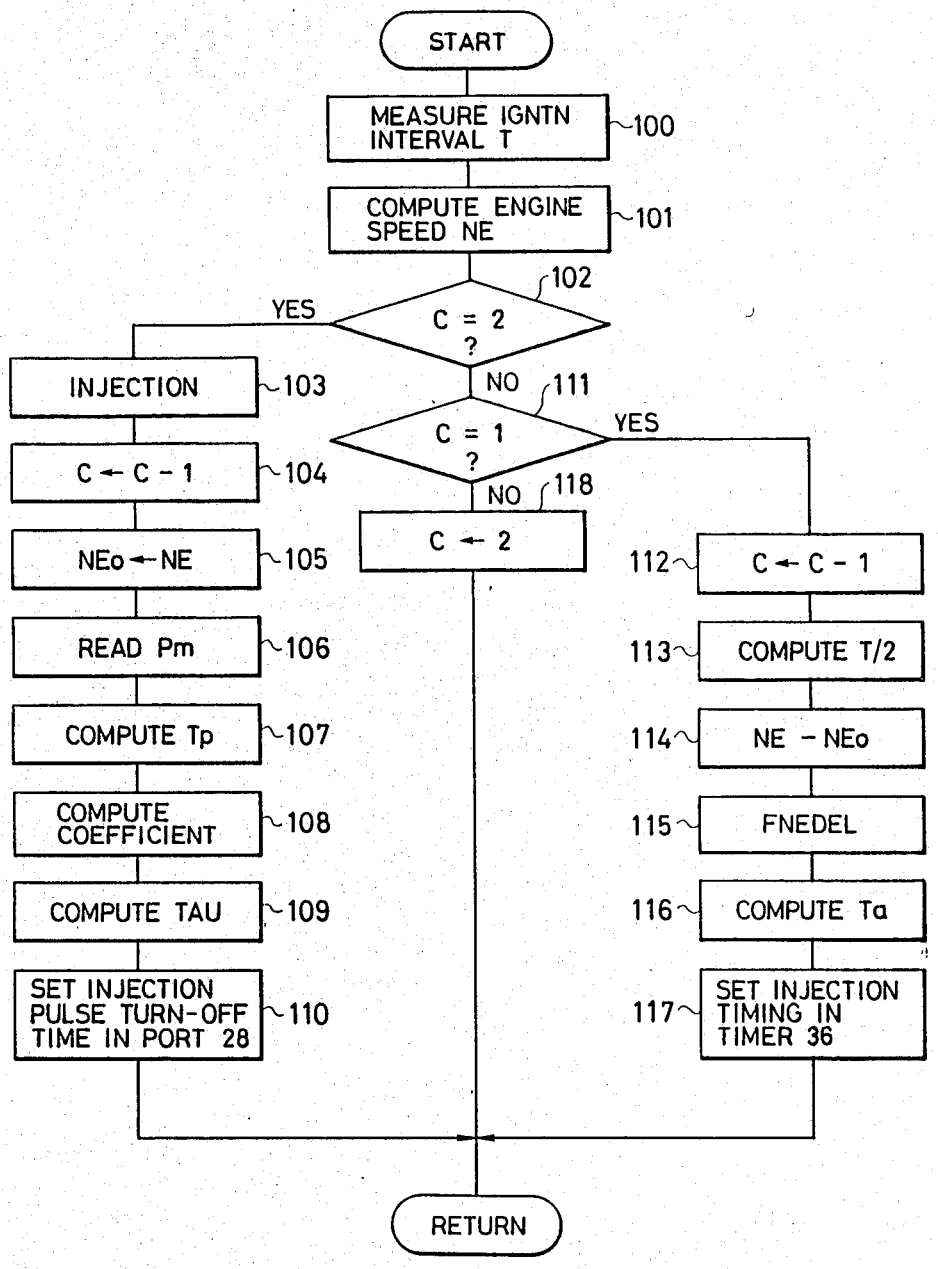
FIG. 5 is a flow chart of the program provided for an electronic fuel injection control system according to the present invention applied to a three-cylinder internal combustion engine.

FIG. 5 is a flow chart of the program provided for an electronic fuel injection control system according to the present invention applied to a three-cylinder internal combustion engine. This is executed in response to an interrupt control signal generated when an ignition signal for the first, second or third cylinder is fed to the control unit 22.

In the first step 100, an ignition pulse interval T is derived from the last and present interrupt control signals. A step 101 follows to compute an engine speed NE in rpm using the interval T derived in the last step 100. In a subsequent step 102, the CPU checks whether the count value of counter C is 2 or not. If "NO", control goes to a step 111, and if "YES", a step 103 is executed to perform fuel injection. The count, which is 2, means the process relating to the fuel injection pulse signal G1 in FIG. 3. In the next step 104, the count of the counter C is decremented in preparation for the next execution of this interrupt routine. A step 105 follows to store the engine speed value NE computed in the previous step 101 as NEo into a storage location of the RAM 24. In a step 106, the present intake air pressure Pm is read through the multiplexer 30, A/D converter 29 and input/output port 26 from the pressure sensor 2, and in a step 107, the basic duration Tp of a fuel injection pulse signal for driving the solenoid-operated valves 7 is derived from the engine speed value NE computed in the step 101 and the intake air pressure Pm obtained in the step 106. In the next step 108, various trimming coefficients are derived from the output signals of the throttle position sensor 4, intake air temperature sensor 5, oxygen sensor 13 and so on. Using the derived various trimming coefficients, the basic pulse duration Tp in the step 107 is trimmed in a step 109 to obtain a final basic pulse duration TAU. Therefore, the trailing edge of the fuel injection pulse G1 is established in this step. The obtained final pulse duration TAU is set in the output port 28 in a step 110 and then this routine is terminated.

In the next execution of this interrupt service routine, the steps 100 and 101 are executed and followed by the step 102. In this case, because the count of the counter C is 1, control goes to a step 111 and further advances to a step 112. The count, which is 1, means the process relating to the fuel injection pulse signal G2 in FIG. 3. In the step 112, the count of the counter C is decremented to zero in preparation for the next execution of this interrupt routine. A subsequent step 113 is executed to obtain the half of the ignition pulse interval T derived in the step 100. The half of the interval T is estimated as the half of the interval between ignition signals E2 and E3 in FIG. 3. In normal engine operating conditions, because the interval between E1 and E2 is equal to that between E2 and E3, the obtained T/2 equals the half of the interval between E2 and E3. The next step 114 is provided for obtaining the difference NE−NEo between the engine speed NE computed in the present execution cycle and the engine speed NEo computed in the last execution cycle. In a step 115, as described in FIG. 4, a trimming coefficient FNEDEL is derived from the difference NE−NEo and an additional period of time Ta is given by the equation $Ta=(T/2)\times FNEDEL$ in the next step 116. In a step 117, a fuel injection timing is obtained in accordance with the additional period of time Ta and is set in the programmable timer 36. After this execution, this routine is terminated and the operational flow returns to a main routine not shown.

In response to the execution in the step 117, the programmable timer 36 starts counting, and after the elapse of the additional period of time Ta, it generates an interrupt control signal and sends to the CPU 23 to execute a programmable timer interrupt service routine shown in FIG. 6 which will be described hereinafter.

Figure 6:
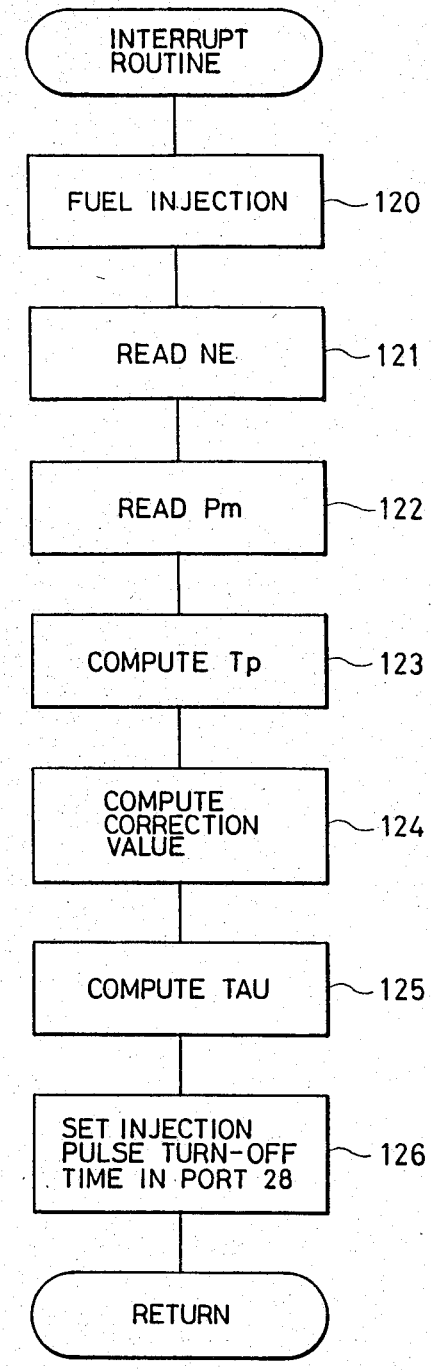
FIG. 6 is a flow chart of the program provided for the fuel injection control unit.

The interrupt routine of FIG. 6 is started in response to the interrupt control signal from programmable timer 36. In the first place, a step 120 is executed to perform fuel injection by the solenoid-operated valves 7. This injection timing corresponds to the leading edge of fuel injection pulse signal G2. A step 121 follows to read the updated engine speed value NE obtained in the step 101 of the routine of FIG. 5. In the next step 122, an intake air pressure value Pm is obtained and in a step 123 a basic pulse duration Tp is derived from the engine speed NE in the step 121 and the intake air pressure value in the step 122. In a subsequent step 124, various trimming coefficients are derived from the output signals of various sensors. In the next step 125, the final pulse duration TAU is obtained by trimming the basic pulse duration Tp using the derived various trimming coefficients. Therefore, the trailing edge of the fuel injection pulse G2 is established in this step. In a subsequent step 126, the pulse duration TAU is set in the output port 28. After this execution, the operational flow returns to the main routine.

Turning back to FIGS. 3 and 5, when the ignition signal E3 for the second cylinder shown in FIG. 3 has been generated, the interrupt service routine of FIG. 5 is started. In this case, because the count value of the counter C is zero, the operational flow goes to a step 118 through the steps 100 to 111, in which the counter C is set to 2, and returns to the main routine.

The above-mentioned operation is repeatedly performed each engine cycle. Therefore, in response to an ignition signal E4 for the first cylinder, a fuel injection pulse signal G3 is generated and supplied to the solenoid-operated valves 7.

Figure 7:
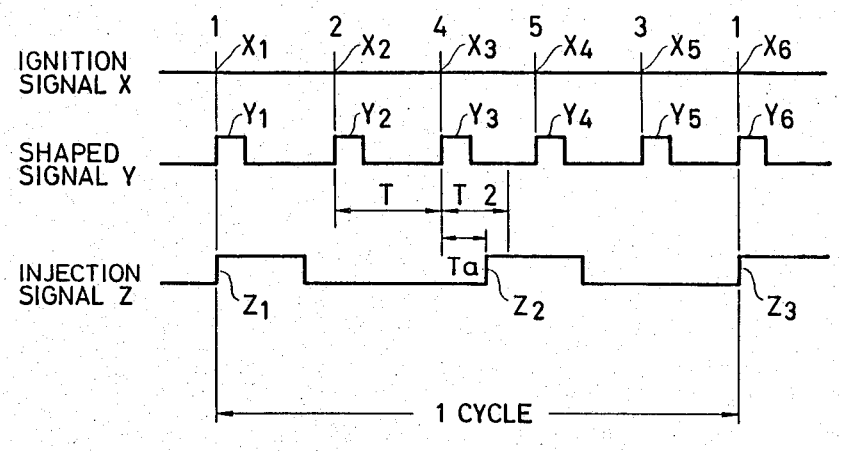
FIG. 7 is a time chart useful for understanding the operation of a fuel injection control system according to the present invention.

FIG. 7 is a time chart useful for understanding the operation of the fuel injection control unit 22 in the case that the present invention is employed for a five-cylinder internal combustion engine.

In five-cylinder internal combustion engines, ignition signals are generated in the order of the first cylinder, second cylinder, fourth cylinder, fifth cylinder and third cylinder which are represented at numerals 1, 2, 4, 5 and 3 in the chart. Designated at the references X1 to X6 are ignition signals supplied from the ignition coil 11 to the waveform shaping circuit 32. The waveform shaping circuit 32 supplies the input/output port 27 with signals designated at the references Y1 to Y6 and fuel injection pulse signals to be supplied to the solenoid-operated valves 7 are represented at the references Zl to Z3. In each engine cycle, two fuel injection pulse signals Z1 and Z2 are generated, the signal Z1 being generated in response to the generation of the ignition signal X1 and the signal Z2 being generated after the elapse of an additional period of time Ta from the generation of the ignition signal X3.

As well as in three-cylinder internal combustion engine, the additional period of time Ta is basically set to the half of ignition pulse interval and is trimmed in accordance with engine operating conditions.

Figure 8:
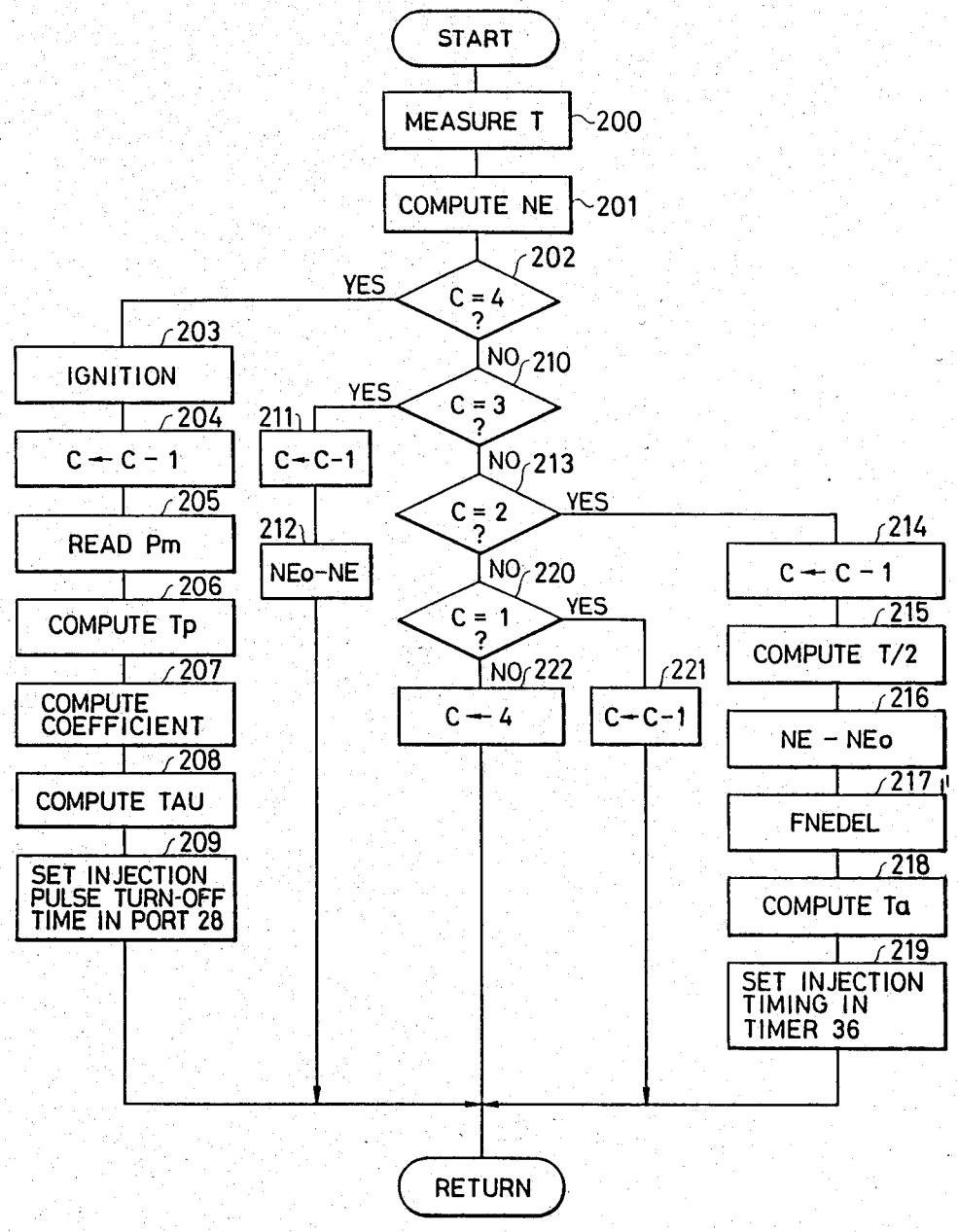
FIG. 8 is a flow chart of the program provided for an electronic fuel injection control system according to the present invention applied to a five-cylinder internal combustion engine.

FIG. 8 is flow chart showing the operation of the fuel injection control unit 22 according to the present invention applied to a five-cylinder internal combustion engine. This flow chart corresponds to the flow chart shown in FIG. 5 which illustrates the operation of the control system according to the present invention applied to a three-cylinder internal combustion engine. The descriptions of the same parts are briefly made or omitted for brevity.

In steps 200 and 201, an ignition pulse interval T and an engine speed NE are obtained, and then control advances to the next step 202 to check the count of counter C. When the execution is made in response to the ignition signal X1, the count of the counter C is set to 4 and therefore steps 203 to 209 are executed which correspond to the steps 103 to 110 except step 105 of the routine shown in FIG. 5. The counter C is decremented by 1 and the fuel injection pulse signal Z1 is generated which is supplied to the solenoid-operated valves 7. When the execution is made in response to the ignition signal X2, because the count value is 3, control goes to a step 211 in which the counter C is decremented by 1 and a step 212 follows to store the obtained engine speed NE into the RAM 24. The engine speed value NE is used as NEo in the next execution. When the execution is made in response to an ignition signal X3, because the count value of the counter C is 2, steps 214 to 219 are executed which correspond to the steps 112 to 117 of the routine shown in FIG. 5. Similarly, the counter C is decremented by 1 and a fuel ignition pulse signal Z2 is generated after the elapse of the additional period of time Ta set in the programmable timer 36 in the step 120 of the interrupt routine shown in FIG. 6. Next, in response to an ignition signal X4, a step 221 is executed whereby the counter is decremented by 1 to cause the count to be set to zero. In the routine finally executed in the engine cycle, a step 222 is executed in response to an ignition signal X5 to set the count value of the counter C to 4.

The above-described embodiments are just examples of the present invention, and therefore, it will be apparent for those skilled in the art that many modifications and variations may be made without departing from the spirit of the present invention.

What is claimed is:

1. A method for controlling fuel injection into an internal combustion engine having an odd number of cylinders using an electronic fuel injection control system, comprising the steps of:

(a) monitoring operating conditions of said engine;

(b) measuring the variation of engine speed in accordance with ignition signals from an ignition unit of said engine;

(c) supplying fuel injectors provided for said engine with the first injection pulse signal in response to the first ignition signal in each engine cycle;

(d) deriving an additional period of time from ignition signals;

(e) trimming said additional period of time to be lengthened when the engine speed is decreasing and to be shortened when the engine speed is increasing; and (f) supplying said fuel injector with the second injection pulse signal after the elapse of the trimmed additional period of time from the generation of the $(m+1)/2^{th}$ ignition signal in each engine cycle where m represents the number of cylinders of said engine.

2. An electronic fuel injection system for an internal combustion engine having an odd number of cylinders and an ignition unit, comprising:

sensor means for monitoring operating conditions of said engine;

injector means for supplying injection fuel to said engine; and control means for: (1) measuring a variation of engine speed using ignition signals from the ignition unit of said engine, (2) supplying said injector means with a first injection pulse signal in response to a first ignition signal in each engine cycle, (3) supplying said injector means with a second injection pulse signal after the elapse of an additional period of time which is set to substantially half of an interval between successive ignitions from the generation of the $(m+1)/2^{th}$ ignition signal in each engine cycle where m represents a number of cylinders of said engine, (4) varying said additional period of time in accordance with the measured speed variation, and (5) deriving the durations of said first and second injection pulse signals as a function of the monitored operating conditions.

3. An electronic fuel injection control system as claimed in claim 2, wherein said sensor means includes at least means for detecting intake pressure of said engine.

4. An electronic fuel injection system for an internal combustion engine having an odd number of cylinders and an ignition unit, comprising:

sensor means for monitoring operating conditions of said engine;

injector means for supplying injection fuel to said engine; and control means for: (1) measuring a variation of engine speed using ignition signals from the ignition unit of said engine, (2) supplying said injector means with a first injection pulse signal in each engine cycle, (3) setting an additional period of time to half of an interval between successive ignitions, (4) trimming said additional period of time in accordance with the measured speed variation, (5) supplying said injector means with a second injection pulse signal after the elapse of said trimmed additional period of time from the generation of the $(m+1)/2^{th}$ ignition signal in each engine cycle, where m represents the number of cylinders of said engine, and (6) deriving the durations of said first and second injection pulse signals as a function of the monitored operating conditions.

5. An electronic fuel injection control system as claimed in claim 4, wherein said sensor means includes at least means for detecting intake pressure of said engine, and said control means is arranged so that said first and second durations are basically derived as a function of the detected intake pressure and the measured engine speed and then trimmed in accordance with the monitored engine operating conditions.

6. An electronic fuel injection system for an internal combustion engine having an odd number of cylinders and an ignition unit, comprising:

sensor means for monitoring operating conditions of said engine;

injector means for supplying injection fuel to said engine; and control means for: (1) measuring the variation of engine speed in accordance with ignition signals from the ignition unit of said engine, (2) supplying said injector means with a first injection pulse signal in response to a first trigger signal corresponding to a first ignition signal in each engine cycle, (3) supplying said injector means with a second injection pulse signal after the elapse of an additional period of time which is set to substantially half of an interval between successive ignitions from the generation of a second trigger signal corresponding to the $(m+1)/2^{th}$ ignition signal in each engine cycle, where m represents the number of cylinders of said engine, (4) controlling said additional period of time to be lengthened when the engine speed is decreasing and to be shortened when the engine speed is increasing, and (5) deriving the durations of said first and second injection pulse signals as a function of the monitored operating conditions.

7. An electronic fuel injection control system as claimed in claim 6, wherein said sensor means includes at least means for detecting intake pressure of said engine, and said control means is arranged so that said first and second durations are basically derived as a function of the detected intake pressure and the measured engine speed and then trimmed in accordance with the monitored engine operating conditions.

8. A method for controlling fuel injection into an internal combustion engine having an odd number of cylinders using an electronic fuel injection control system, comprising the steps of:

(a) monitoring operating conditions of said engine;

(b) measuring the variation of engine speed in accordance with ignition signals from an ignition unit of said engine;

(c) supplying fuel injectors provided for said engine with a first injection pulse signal in response to a first ignition signal in each engine cycle;

(d) deriving an additional period of time from ignition signals;

(e) trimming said additional period of time in accordance with the measured speed variation; and (f) supplying said fuel injector with a second injection pulse signal after the elapse of the trimmed additional period of time from the generation of the $(m+1)/2^{th}$ ignition signal in each engine cycle where m represents the number of cylinders of said engine.

9. A control method as claimed in claim 8, wherein the durations of said first and second injection pulse signals each indicative of the quantity of fuel to be injected into said engine are determined on the basis of the monitored operating conditions and the measured engine speed.

10. A control method as claimed in claim 8, wherein the durations of said first and second injection pulse signals each indicative of the quantity of fuel to be injected into said engine are determined on the basis of the monitored operating conditions and the measured engine speed.

* * * * *